United States Patent [19]

Minton

[11] Patent Number: 4,976,819

[45] Date of Patent: Dec. 11, 1990

[54] PULP TREATMENT METHODS

[75] Inventor: Mary L. Minton, Cloquet, Minn.

[73] Assignee: Potlatch Corporation, Cloquet, Minn.

[21] Appl. No.: 187,660

[22] Filed: Apr. 28, 1988

[51] Int. Cl.[5] ..... D21C 9/00

[52] U.S. Cl. ..... 162/9; 162/56; 162/111

[58] Field of Search ..... 162/100, 182, 9, 232, 162/56, 111; 241/28

[56] References Cited

U.S. PATENT DOCUMENTS

| | | | |
|---|---|---|---|
| 1,162,797 | 12/1915 | Melchers | 162/20 |
| 2,000,562 | 5/1935 | Haglund | 92/13 |
| 2,355,091 | 8/1944 | McDonald | 68/21 |
| 2,516,384 | 7/1950 | Hill et al. | 162/100 |
| 2,561,013 | 7/1951 | Coghill et al. | 162/232 |
| 2,771,361 | 11/1956 | Birdseye et al. | 162/17 |
| 2,943,012 | 6/1960 | Dunning et al. | 162/28 |
| 3,016,324 | 1/1962 | Textor | 162/24 |
| 3,028,632 | 4/1962 | Coghill | 19/66.1 |
| 3,054,532 | 9/1962 | Erickson | 222/56 |
| 3,382,140 | 5/1968 | Henderson et al. | 162/28 |
| 3,454,970 | 7/1969 | Sutherland | 8/156 |
| 3,533,510 | 10/1970 | Glowacki | 210/374 |
| 3,589,977 | 6/1971 | Fournet | 162/9 |
| 3,597,310 | 8/1971 | Sumi et al. | 162/25 |
| 3,773,610 | 11/1973 | Shouvlin et al. | 162/19 |
| 3,809,604 | 5/1974 | Estes | 162/100 |
| 3,943,033 | 3/1976 | Wallen | 162/18 |
| 4,036,679 | 7/1977 | Back et al. | 162/9 |
| 4,121,967 | 10/1978 | Reinhall | 162/246 |
| 4,297,164 | 10/1981 | Lee | 162/60 |
| 4,298,425 | 11/1981 | Ranzen et al. | 162/18 |
| 4,324,612 | 7/1982 | Lindahl | 162/23 |
| 4,347,101 | 8/1982 | Villavicencio | 162/25 |
| 4,409,065 | 10/1983 | Kasser | 162/9 |
| 4,431,479 | 2/1984 | Barbe et al. | 162/9 |
| 4,486,267 | 12/1984 | Prusas | 162/25 |
| 4,488,932 | 12/1984 | Eber et al. | 162/9 |
| 4,773,965 | 9/1988 | Glinski et al. | 162/9 |

FOREIGN PATENT DOCUMENTS 1103413 6/1981 Canada .

OTHER PUBLICATIONS

R. S. Seth, et al., "The Strength of Wet Webs: A New Approach", *Tappi,* Mar. 1982, vol. 65, No. 3, pp. 135–138.

Derek H. Page et al., "The Extensional Behavior of Commercial Mechanical Pulps", *Pulp & Paper Canada,* vol. 80, No. 8, Aug. 1979, pp. 52–54.

Hill, Edwards & Beath, "Curlated Pulp–A New Approach to Pulp Processing", Industrial Development Section, Mar. 17, 1949, p. 92.

"Papermaking Raw Materials—Their Interaction with the Production Process and Their Effect on Paper Properties", *Mechanical Engineering Publications Limited,* vol. 1.

Thorton & Nunn, "The Effect of a Plug Screw Feeder on Ether—Solubles Removal and Power Reduction During TMP Manufacture", *TAPPI,* 1978.

Brauns, "The Frotapulper in Modern Papermaking", *Svensk Papperstidining,* 75, 1972:3, 81.

Davis, John, "Papermaking Warm Up to Thermomechanical Pulping", Chemical Engineering, Dec. 1976, pp. 89–91.

Lunan, W. E. et al., "Curl–Setting During Storage of Thermomechanical Pulp at High Consistency", 1985 Pulp Conference TAPPI Proceedings.

*Primary Examiner*—David Simmons

*Assistant Examiner*—Thi Dang

*Attorney, Agent, or Firm*—Wells, St. John & Roberts

[57] ABSTRACT

Mechanical treatment of a pulp slurry of up to 50% O.D. consistency by dewatering and compacting the pulp permanently twists and kinks individual fibers to a degree that is substantially irreversible when they are subsequently subjected to papermaking process steps. The preferred device for imparting such permanent twisting and kinking is a plug screw feeder. Pulp that has been so treated exhibits increased desired drainability in the wet section of a papermachine. Such treated pulp also loses water vapor more easily in the dryer section than untreated pulp, and correspondingly results in less energy consumption in the dryer section of a papermachine. Pulp treated in accordance with the invention also exhibits increased absorbency. Tissue or other soft paper products produced from softwood pulp treated in accordance with the invention exhibit significantly increased softness over such untreated softwood pulp. Pulp treated in accordance with the invention is also useful in enhancing properties, for example bulk, in other paper products.

25 Claims, 1 Drawing Sheet

NOT TREATED

TREATED

PULP TREATMENT METHODS

TECHNICAL FIELD

This invention relates primarily to methods for manipulating or treating pulp to enhance particular properties in finished paper products produced from such pulp.

BACKGROUND OF THE INVENTION

This invention arose initially from the need to be able to produce soft tissue products from western softwoods. Western softwoods produce a rather harsh product. Different pulp species are frequently blended with softwood pulps to improve softness. However for certain papermills, a wide variety of species for blending is not readily available. Purchased pulp can be more costly than pulp manufactured from the more readily available softwoods for such paper mills. Thus, economics dictate that tissue be made mostly from pulp produced on site.

Small improvements can be made to tissue softness by methods such as chemical additions, optimizing creping and other papermaking operations, and sheet post treatments such as embossing. Such methods may not always produce the required softness.

The prior art has recognized that specific mechanical treatments of certain pulps prior to its formation into a sheet can enhance softness. For example, U.S. Pat. No. 4,036,679 to Back et al. discloses a disc-refiner treatment method for treating pulp to improve various properties, including softness. The process employs the feeding of dried pulp of a consistency of approximately 70% to 90% O.D. (oven dried) by weight through a disc refiner. The pulp exiting the refiner is fluffed and fiberized, has increased bulk, decreased tensile strength, increased absorbency, increased freeness, and improved softness. Manipulation of such dried and fluffed pulp is not without drawbacks. Also, there are added costs associated with drying or removing water from pulp to achieve a 70% to 90% consistency.

U.S. Pat. No. 2,516,384 to Hill et al. and an article authored by Hill and others (H. S. Hill, J. Edwards, and L. R. Beath, "Curlated Pulp—A New Approach to Pulp Processing", *Paper Trade Journal*, pp. 19–27, Mar. 17, 1949) discloses a mechanical pulp treatment process to impart curl and incidently softness using lower consistency pulp than that taught by the Back et al. patent. In the Hill process, pulp at a consistency between 2% and 60% is confined under mechanical pressure between two elements which are in relative gyratory or reciprocal motion. This creates nodules or balls of pulp between the opposed working elements. Although Hill et al. assert that the curl imparted to their fibers was permanent, the effect was determined to be temporary. For example, the Back et al. '679 patent indicates that the fiber modification of Hill et al. was not lasting in nature since a large amount of the twists, kinks, and bends dissipated upon standing over a 24 to 48 hour time period. It was theorized that this was due to the substantial amount of water that surrounds and is contained within the fibers which tends to reduce the amount of lasting structural distortion which might otherwise result. (U.S. Pat. No. 4,036,679, column 1, line 62 through column 2, line 6.) Further, the Hill et al. article indicates that freeness of its product under the best conditions is increased only slightly, and typically decreased after heavy working.

Curlation, kinking and twisting of fibers might also generate improvements in the papermaking process for the finished product apart from increased softness. For example, Hill et al. in their article recognize that curlation enhances dewatering of wet pulp in the wet press or couch section of the papermachine where pressure is applied to squeeze water from the sheet. They also recognize that curlation enhances loss of water vapor upon drying, although none of these effects was quantified. Other improvements might also be realized.

DETAILED DESCRIPTION OF PREFERRED EMBODIMENTS

Figure 1:
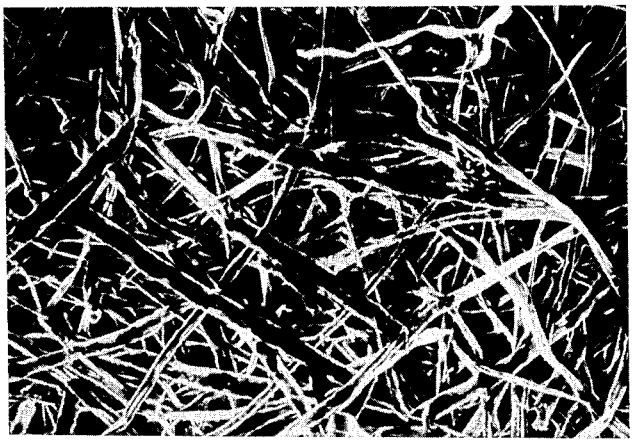
FIGS. 1 and 2 display scanning electron micrographs of handsheets formed from pulp treated in accordance with the invention and from untreated pulp.
Figure 2:
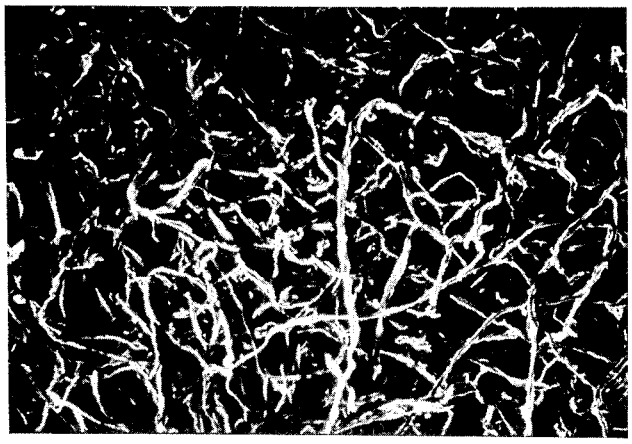

The following disclosure of the invention is submitted in compliance with the constitutional purpose of the Patent Laws "to promote the progress of science and useful arts" (Article 1, Section 8).

In one aspect of the invention, a method is provided for producing an improved soft paper product by manipulating pulp prior to its formation into a sheet on a papermaking machine. Pulp of up to 50% O.D. consistency is mechanically treated by wringing, dewatering and compacting the pulp to permanently twist and kink individual fibers to a degree that is substantially irreversible when they are subsequently subjected to papermaking process steps. Preferably the wringing, dewatering and compacting occur simultaneously. The treated pulp has increased freeness, reduced tensile strength, increased bulk, reduced tearing resistance, and is softer than the same pulp that has not been so mechanically treated to twist and kink individual fibers. It is believed that compacting the kinked and twisted fibers for some period of time more permanently sets these characteristics and enables them to survive subsequent papermaking steps.

The preferred mechanical device for treating the pulp is a plug screw feeder which moves the pulp along an annular path of decreasing volume. The plug screw feeder should preferably have a nominal compression ratio of from 2.0:1 to 8.0:1, and will typically discharge pulp at about fifty to sixty percent O.D. Devices other than plug screw feeders are also anticipated to be usable for treating up to 50% O.D. pulp without departing from the principles and scope of the invention.

The treated pulp is then processed into a finished paper product using conventional papermachines and papermaking techniques. Excessive heat, agitation or shear is preferably minimized before passing the pulp to the head box.

Pulps of a consistency of up to 50% O.D. treated in accordance with this aspect of the invention to improve softness will typically exhibit increased freeness of at least 5%; reduced tensile strength of at least 30%; increased bulk of at least 20%; reduced tearing resistance of at least 10%; and increased absorbency capacity and absorbency rate of at least 10% than the same pulp that has not been mechanically treated to twist and kink individual fibers. At the time of drafting this document, the following changes were observed when a plug screw feeder was used to treat various pulps: increased freeness of 52%; reduced tensile strength of 87%; increased steel bulk of 56%; reduced tearing resistance of 87%; increased absorbency capacity of 46%; and increased absorbency rate of 71%. Where a plug screw feeder or similar device is used, the flow of pulp exiting therefrom is preferably restricted somewhat to impart the greatest lasting changes in these pulp properties. An example of such a device for flow restriction is a blow-back damper, which is conventionally used to regulate pulp feed to a digester. Another example of such a flow restriction device is an extended discharge tube with or without an additional mechanical flow restrictor.

Tables 1-3 show properties of Test Samples 1-4 which comprise pulp treated in accordance with the invention, as compared to the same properties of non-treated control pulp. Each of pulp Test Samples 1-4 was treated with a plug screw feeder whose outlet was connected to a blow-back damper. Table 1 illustrates standard paper test results on pulp formed into 0.5 gm handsheets. The testing was performed and the handsheets were made primarily according to standard TAPPI guidelines. Differences from the standards are noted below.

Handsheets: The pulp was prepared by hot disintegration in boiling water for ten minutes with an agitator operating at 3,000 r.p.m., and diluted to 0.3% consistency. Handsheets were then formed.

Drying: The handsheets were dried on a hot plate, as opposed to pressing. The sheets were placed between 200 mesh screens and held in place for 1 to 2 minutes at 300° F. to the point of just becoming dry.

Bulk: Uncompressed bulk was determined by use of a thickness gauge, TMI (Testing Machines, Inc.) Model 49-21-00, and dividing by basis weight.

Tensile: Tensile was tested on one-inch wide strips, and the reading in grams was divided by the basis weight.

WRV: The method used was as described by J. G. Penniman in the May 30, 1981 issue of *Paper Trade Journal*, at pages 44 and 45.

Control 1 pulp consisted essentially of western softwoods comprised primarily of Douglas Fir, true firs and Western Pines. Test Samples 1 and 2 were fractions of Control 1 pulp that were fed to different compression ratio plug screw feeders, as indicated in Table 1. The consistency of the analyzed Control 1 pulp, and that fed to the plug screw feeders of Test Samples 1 and 2, was 36%. The consistency of the pulp exiting the Test Sample 1 plug screw feeder was 50%, while that exiting the Test Sample 2 plug screw feeder was 53%. It was not understood at this writing why the lower compression ratio plug screw feeder removed slightly more water than the higher compression ratio plug screw feeder. It is possibly due to a function of screw flight filling efficiency at the screw inlet chamber. Also, exiting consistency is not necessarily a direct indicator of the degree of the effects from the treatment. As is apparent from Table 1, there are significant changes in the measurable properties of the pulp as the result of the mechanical treatment.

Softness is a subjective characteristic having no standardized test to determine its presence. Table 2 illustrates averages of panel results of feel tests of handsheets made from various pulps. Eleven panelists were asked to assign a relative softness number between 1 and 10 to each sample, with 10 being defined as the softest and 1 being defined as the least soft.

TABLE 2

SHEET SOFTNESS AND OTHER PROPERTIES FOR DIFFERENT PULPS

| | Panel Softness Numerical Average | Curl Index | Uncompressed Bulk | Tensile Index |
|---|---|---|---|---|
| Test Sample 3 (Control 2 of 32.5% consistency treated with a plug screw feeder having a nominal compression ratio of 4 to 1) | 9.1 | .22 | 8.5 | 12 |
| 25% hardwood-75% Control 2 | 7.2 | — | 5.5 | 58 |
| Control 2 dewatered to 32.5%, and passed through a Frotapulper (tm) | 4.5-5.4 | .27 | 6.0-7.4 | 33-37 |
| Control 3-passed through a disk refiner, (25%) refined northern pine | 2.1 | .37 | 5.4 | 83 |
| Control 2 dewatered to 32.5%, but otherwise untreated | 2 | .086 | 4.9 | 76 |
| Control 2 (5% consistency) | 1 | — | 5.6 | 78 |

Control 2 pulp consisted essentially of western softwood pulp slurried to a 5% consistency. Control 3 pulp consisted essentially of Jack pine and red pine fibers. A Frotapulper (a trademark understood to be owned by Kamyr Inc. of Glen Falls, N.Y.) is a device which is presently primarily used to treat chemical pulp rejects and deresinate sulfite pulp.

Table 2 also indicates curl index (the ratio of projected fiber length to actual fiber length). The results indicate that curl by itself is not directly correlated with softness. Table 2 also illustrates that tensile generally decreases with improved softness, while uncompressed bulk generally increases. Softness improvements are expected to occur regardless of whether the pulp is

TABLE 1

PROPERTIES OF HANDSHEETS MADE FROM TREATED AND UNTREATED PULP

| | Plug Screw Feeder Nominal Compression Ratio | CSF (Freeness) | Tensile Index | Uncompressed Bulk | Steel Bulk | % Dry Stretch | Zero Span Tensile | Tear | WRV (Water Retention Value) | Absorbency Capacity | Absorbency Rate |
|---|---|---|---|---|---|---|---|---|---|---|---|
| Control 1 | — | 668 | 54 | 5.7 | 4.0 | 1.7 | 14.4 | 127 | 1.96 | 7.3 | 15.2 |
| Test Sample 1 | 4.1 | 744 | 7 | 9.4 | 5.8 | 1.4 | 9.3 | 16.6 | 1.15 | 9.3 | 5.6 |
| Test Sample 2 | 2.9 | 703 | 25 | 7.2 | 4.8 | — | 10.4 | 71 | 1.41 | — | — |

comprised of hardwoods, softwoods, or a mixture thereof.

FIG. 1 displays scanning electron micrographs at 140× magnification of handsheets formed from pulp treated in accordance with the invention and from untreated pulp. The micrographs illustrate that fibers of the treated handsheet have been significantly kinked, rolled and twisted. The fibers exhibit no fibrillation (unravelling of fiber walls), or internal bruising which would cause fibers to retain water or develop bonding surfaces which would add strength or reduce softness. This at least partially explains the reduced WRVs (water retention values) for the treated pulp reported in Table 1.

The invention is anticipated to have specific application for treating chemical pulp comprised primarily of softwoods such as Balsam Firs, Douglas Fir and Western Pines which have been fully bleached and chemically treated and intended to produce tissue products. In such a preferred process, the chemical pulp would be processed to a consistency of from 5% to 20% O.D. Next, such pulp would be passed through a plug screw feeder having a nominal compression ratio of at least 2.0:1, and preferably having its outlet restricted by a blowback damper or other restriction device. The pulp exiting the plug screw feeder will have increased freeness, reduced tensile strength, increased bulk, and reduced tearing resistance than the same pulp which has not been passed through a plug screw feeder to twist and kink individual fibers. The paper product produced at least partially from such pulp will exhibit substantially increased softness over the same pulp that has not been so treated.

In addition to increasing softness in tissue paper products, pulp treated in accordance with the invention has been determined to improve certain aspects of the papermaking process and to produce other improvements in paper products produced at least partially from such pulp. One improvement relates to pulp drainability. Drainability is of primary importance in the initial dewatering section of a papermachine where pulp is formed into a sheet on and dewatered through a wire support. At this stage in the process, fines or small pulp fibers are commonly drawn through the wire screen by the various dewatering elements positioned directly beneath the screen. It is generally recognized that the presence of these fines in the pulp as it dewaters reduces inherent drainability. Also, the lab test freeness correlates with drainability. The higher the freeness, the greater the drainability of the pulp. Accordingly, pulp treated in accordance with the invention to permanently twist and kink individual fibers will result in increased drainability of pulp in the forming section and improved pressability in the press section of the papermachine, as indicated by increased freeness and lower Water Retention Value (WRV), regardless of the pulp and regardless of the paper product being produced. This allows faster paper machine speeds.

Improvements in drainability of high fines content pulp are also obtained by treating such in pulp in accordance with the invention. For example, water that has been removed from the wet section of the papermachine beneath the wire is collected and passed through a straining device commonly referred to as a "saveall," which has a pulp mat to collect fines. The saveall acts as a strainer to separate the fines or small fibers from the water so that they can be passed back into the headbox for a subsequent pass through the papermachine. The product exiting the saveall typically has an O.D. consistency of between 4% and 15%. It has been determined that mechanically treating the high fines content pulp exiting from the saveall in accordance with the invention prior to feeding it back to the headbox imparts significant improvements in drainability of the forming sheet. The forming sheet, having such treated pulp added, will exhibit increased freeness in achieving the increased drainability and pressability apart from any affect that might be imparted to tensile, bulk, or tearing resistance of the finished paper product.

Table 3 illustrates test results for another control pulp (Control 4) obtained from the saveall and such pulp treated with a plug screw feeder having a nominal compression ratio of 5.5 to 1 (Test Sample 4). Control 4 pulp also consisted essentially of pulp created from western softwoods comprised primarily of Balsam Firs, Douglas Fir and Western Pines. It had a high fines content and a consistency of 6%, both as analyzed and fed to the plug screw feeder. The consistency of the Test Sample 4 pulp exiting the plug screw feeder was 46%.

TABLE 3

PROPERTIES OF HANDSHEETS MADE FROM PULP OBTAINED FROM A SAVEALL

| | Plug Screw Feeder Nominal Compression Ratio | CSF (Freeness) | Tensile Index | Uncompressed Bulk | Steel Bulk | % Dry Stretch | Zero Span Tensile |
|---|---|---|---|---|---|---|---|
| Control 4 | — | 425 | 61.3 | 6.4 | 4.5 | 2.3 | 11.8 |
| Test Sample 4 | 5.5 | 647 | 32.2 | 7.4 | 4.9 | 2.0 | 9.5 |

Other improvements occur by adding pulp treated in accordance with the invention to the headbox regardless of the paper product being produced and regardless of whether the pulp feed material was obtained from the saveall. For example, treated pulp has been determined to lose water vapor more easily than untreated pulp in the dryer section of the papermachine. This will result in less steam (energy) consumption. Actual papermachine trials have demonstrated a 12.5% savings in natural gas consumption (i.e. 0.35 million BTUs/ton of production). This would correspond to drying energy savings of 5% where approximately 50% of the pulp being fed to the headbox has been treated in accordance with the invention.

Further, treated pulp is also useful in improving paperboard products. Multilayer paperboard produced with treated pulp in the middle ply allows reduction in sheet basis weight due to increase in pulp bulk, and yet maintains overall thickness.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims, appropriately interpreted in accordance with the doctrine of equivalents.

I claim:

1. A method for producing improved soft paper products by mechanically treating pulp of up to 50% O.D. consistency, comprising the steps of:

wringing, dewatering and compacting the pulp of up to 50% O.D. consistency to permanently twist and kink individual fibers to a degree that is substantially irreversible when they are subsequently subjected to papermaking process steps, the treated pulp having, (a) increased freeness;

(b) reduced tensile strength;

(c) increased bulk;

(d) reduced tearing resistance; and (e) greater softness, over the same pulp that has not been so mechanically treated; and feeding the treated pulp into a headbox of a papermaking machine to produce a paper product having greater softness than a paper product made from the same pulp that has not been so mechanically treated.

2. The method of claim 1 wherein the step of wringing, dewatering and compacting the pulp comprises moving the pulp along an annular path of decreasing volume.

3. The method of claim 2 wherein the step of wringing, dewatering and compacting the pulp comprises passing the pulp through a plug-screw feeder.

4. The method of claim 3 further comprising:

restricting the flow of pulp exiting from the plug screw feeder.

5. The method of claim 1 further comprising, before said feeding, the steps of, diluting the treated fiber pulp to a more fluid consistency; and agitating the diluted pulp for a sufficient time at a sufficient temperature to substantially individually suspend the kinked and twisted fibers and to break up any clumps of fibers created during the mechanical treating step.

6. The method of claim 1 wherein wringing, dewatering and compacting of the pulp occur simultaneously.

7. A method of manipulating pulp comprising the steps of:

mechanically treating pulp of up to 50% O.D. consistency by wringing, dewatering and compacting the pulp to permanently twist and kink individual fibers to a degree that is substantially irreversible when they are subsequently subjected to papermaking process steps, the treated pulp having increased freeness and thereby increased drainability in the wet sections of a paper machine over the same pulp that has not been wrung, dewatered and compacted to twist and kink individual fibers.

8. The method of claim 7 wherein the step of wringing, dewatering and compacting the pulp comprises moving the pulp along an annular path of decreasing volume.

9. The method of claim 8 wherein the step of wringing, dewatering and compacting the pulp comprises passing the pulp through a plug-screw feeder.

10. The method of claim 9 further comprising:

restricting the flow of pulp exiting from the pulp screw feeder.

11. The method of claim 7 wherein wringing, dewatering and compacting of the pulp occur simultaneously.

12. A method for producing improved absorbent paper products by mechanically treating pulp of up to 50% O.D. consistency, comprising the steps of:

wringing, dewatering and compacting the pulp of up to 50% O.D. consistency to permanently twist and kink individual fibers to a degree that is substantially irreversible when they are subsequently subjected to papermaking process steps, the treated pulp having, (a) reduced tensile strength;

(b) increased bulk;

(c) reduced tearing resistance; and (d) greater absorbency, over the same pulp that has not been so mechanically treated; and feeding the treated pulp into a headbox of a papermaking machine to produce a paper product having greater abosrbency than a paper product made from the same pulp that has not been so mechanically treated.

13. The method of claim 12 wherein the step of wringing, dewatering and compacting the pulp comprises moving the pulp along an annular path of decreasing volume.

14. The method of claim 13 wherein the step of wringing, dewatering and compacting the pulp comprises passing the pulp through a plug-screw feeder.

15. The method of claim 14 further comprising:

restricting the flow of pulp exiting from the plug screw feeder.

16. The method of claim 12 wherein wringing, dewatering and compacting of the pulp occur simultaneously.

17. A method of manipulating pulp comprising the steps of:

mechanically treating pulp of up to 50% O.D. consistency by wringing, dewatering and compacting the pulp to permanently twist and kink individual fibers to a degree that is substantially irreversible when they are subsequently subjected to papermaking process steps, the treated pulp having increased bulk over the same pulp that has not been wrung, dewatered and compacted to twist and kink individual fibers.

18. The method of claim 17 wherein wringing, dewatering and compacting of the pulp comprises moving the pulp along an annular path of decreasing volume.

19. The method of claim 18 wherein wringing, dewatering and compacting of the pulp comprises passing the pulp through a plug screw feeder.

20. The method of claim 19 further comprising:

restricting the flow of pulp exiting from the plug screw feeder.

21. The method of claim 17 wherein wringing, dewatering and compacting of the pulp occur simultaneously.

22. A method for producing improved soft paper products by mechanically treating pulp of up to 50% O.D. consistency, comprising the steps of:

wringing, dewatering and compacting the pulp of up to 50% O.D. consistency to permanently twist and kink individual fibers to a degree that is substantially irreversible when they are subsequently subjected to papermaking process steps, the treated pulp having, (a) increased freenes of at least 5%;
(b) reduced tensile strength of at least 30%;
(c) increased bulk of at least 20%;
(d) reduced tearing resistance of at least 10%; and
(e) greater absorbency;
(f) greater softness, over the same pulp that has not been so mechanically treated; and feeding the treated pulp into a headbox of a papermaking machine to produce a paper product having greater softness and absorbency than a paper product made from the same pulp that has not been so mechanically treated.

23. The method of claim 22 wherein wringing, dewatering and compacting of the pulp occur simultaneously.

24. A method of treating pulp to produce an improved soft paper product, the pulp consisting essentially of chemical pulp, the method comprising the steps of:

preparing chemical pulp to obtain a consistency of from 5% to 20% O.D.;

passing the 5% to 20% O.D. chemical pulp through a plug screw feeder having a nominal compression ratio of at least 2.0 to 1 to wring, dewater and compact the pulp and to permanently twist and kink individual fibers to a degree that is substantially irreversible when they are subsequently subjected to papermaking process steps, and thus producing a treated chemical pulp;

restricting the flow of the treated chemical pulp exiting from the plug screw feeder;

the treated chemical pulp existing the restricted plug screw feeder having, (a) increased freeness;
(b) reduced tensile strength;
(c) increased bulk;
(d) reduced tearing resistance; and
(e) greater softness, than the same pulp which has not been passed through a plug screw feeder to twist and kink individual fibers; and feeding the treated chemical pulp into a headbox of a papermaking machine to produce a paper product having greater softness than a paper product made from the same chemical pulp that has not been so mechanically treated.

25. A method of treating pulp to produce an improved soft paper product, the pulp consisting essentially of softwood chemical pulp, the method comprising the steps of:

preparing softwood chemical pulp to obtain a consistency of from 5% to 50% O.D.;

passing the 5% to 50% O.D. softwood chemical pulp through a plug screw feeder having a nominal compression ratio of at least 2.0 to 1 to wring, dewater and compact the pulp and to permanently twist and kink individual fibers to a degree that is substantially irreversible when they are subsequently subjected to papermaking process steps, and thus producing a treated softwood chemical pulp;

restricting the flow of the treated softwood chemical pulp exiting from the plug screw feeder;

the treated softwood chemical pulp having, (a) increased freeness;
(b) reduced tensile strength;
(c) increased bulk;
(d) reduced tearing resistance; and
(e) greater softness, than the same softwood chemical pulp which has not been passed through a plug screw feeder to twist and kink individual fibers; and feeding the treated softwood chemical pulp into a headbox of a papermaking machine to produce a paper product having greater softness than a paper product made from the same softwood chemical pulp that has not been so mechanically treated.

* * * * *